US005108162A

United States Patent [19]

Lund

[11] Patent Number: 5,108,162

[45] Date of Patent: Apr. 28, 1992

[54] MEDICINE CABINET AND JEWELRY BOX COMBINATION

[76] Inventor: Jacqueline A. Lund, 1318 B Dupont Ave., Morris, Ill. 60450

[21] Appl. No.: 626,512

[22] Filed: Dec. 12, 1990

[51] Int. Cl.[5] ..... E05B 00/00

[52] U.S. Cl. ..... 312/215; 292/213; 49/395; 312/324

[58] Field of Search ..... 49/394, 395; 292/213, 292/218, DIG. 21; 312/215, 222, 324

[56] References Cited

U.S. PATENT DOCUMENTS

| | | | |
|---|---|---|---|
| 838,437 | 12/1906 | McDaniel | 292/213 |
| 1,254,132 | 1/1918 | Garman . | |
| 1,898,543 | 2/1933 | Johnson | 292/218 |
| 2,575,530 | 11/1951 | Reid . | |
| 3,298,764 | 1/1967 | Goldfarb . | |
| 3,997,219 | 12/1976 | Phelps . | |
| 4,023,872 | 5/1977 | Palka et al. . | |
| 4,324,446 | 4/1982 | LeSaye | 312/245 |
| 4,385,551 | 5/1983 | Zboralski | 292/DIG. 12 |
| 4,396,249 | 8/1983 | Aisley | 312/227 |
| 4,776,650 | 10/1988 | Ferenzi . | |

FOREIGN PATENT DOCUMENTS 1111959 7/1961 Fed. Rep. of Germany ..... 292/213

*Primary Examiner*—Kenneth J. Dorner
*Assistant Examiner*—Gerald A. Anderson
*Attorney, Agent, or Firm*—Ernest Kettelson

[57] ABSTRACT

A medicine cabinet and jewelry box combination comprising a plurality of separate compartments in a single wall hung cabinet, each in side by side relationship, each having its own door pivotally mounted on a vertically extending hinge pin or pins to open and close in a horizontally extending arcuate path, at least one of the plurality of compartments, constructed to store jewelry items on hooks, on pivotally mounted rods, on shelves and in drawers and at least one of the compartments constructed to store medicinal items, the compartments to store medicinal items being constructed to prevent vapors, caustic substances, toxic substances and odors from reaching the jewelry items stored in the jewelry compartments both when the door to the jewelry compartments is open as well as when closed.

2 Claims, 6 Drawing Sheets

MEDICINE CABINET AND JEWELRY BOX COMBINATION

BACKGROUND OF THE INVENTION

This invention relates to the field of wall mounted cabinets usually placed in bathrooms which usually hold medicinal items, and in particular to those which provide a separate compartment or space to store items other than medicines.

There are prior art cabinets of this type which provide separate spaces to store two different categories of materials, but none known to the inventor which are constructed to completely isolate a compartment for medicine from jewelry items in an adjacent compartment both when the door to the jewelry compartment is open as well as when closed.

Examples of prior art wall mounted cabinets in this general field which are known to the inventor include those shown and described in the following United States patents:

U.S. Pat. No. 4,776,650 discloses a wall mounted cosmetic center having a compartment for cosmetics and two doors hinged respectively on each side to open and close the cosmetics compartment, the outwardly facing side of each door having a mirror, and the inwardly side of each door having hooks and racks on which to store jewelry items. When the doors are closed, the jewelry items are in direct facing relationship with the cosmetic items or whatever else is stored in the cosmetics compartment, fully exposed to whatever vapors, fumes, airborne caustic particles, airborne toxic materials, odors and the like emanate therefrom.

U.S. Pat. No. 4,396,249 discloses an adjustable mounting support for mirrors wherein the mirrors can be manipulated into many different portions, being hinged on brackets which themselves are hinged to the doors of the cabinet. There is nothing to prevent vapors, fumes and the like from one compartment entering another compartment to contaminate whatever is stored therein since all doors can be opened at the same time.

U.S. Pat. No. 4,324,446 discloses a jewelry case having a single compartment and two doors hinged on each side respectively to open and close the compartment. The compartment provides hooks on which to hang necklace and other jewelry chains, and the inside wall of each door includes hooks for similar jewelry items as well as supports for earrings and other types of jewelry.

U.S. Pat. No. 4,023,872 discloses a bathroom cabinet having three compartments molded in a single piece, each compartment having a door, and instead of any structure to isolate the contents of one from vapors, fumes and the like from another, all three of the compartments have vertically extending spaces between their adjacent walls and the inside wall of the doors when closed. Fumes and vapors from any one can flow into both of the others.

U.S. Pat. No. 3,997,219 discloses a jewelry cabinet for placement on a table top, having a transparent swinging door the rear surface of which has shelves, the rear edge of which have vertical strips with inverted V-shaped slots from which to hang jewelry items.

U.S. Pat. No. 3,298,764 discloses a wall mounted cabinet having a single compartment, a door hinged at one side, and a drawer within the compartment in addition to one or more shelves.

U.S. Pat. No. 2,575,530 discloses a medicine cabinet having a circular or convex outer configuration, an outer door having a convex outwardly facing surface and concave inwardly facing surface, and an inner door which is flat, the concave inwardly facing surface of the outer door having a magnifying mirror, the outwardly facing surface of the inner door having a plain mirror, shelves for medicinal items behind the inner door and a lock box also behind the inner door, plus a number of other features having little or nothing to do with the features of the present invention.

U.S. Pat. No. 1,254,132 discloses a medicine cabinet having a single large compartment with a door hinged at one side, shelves and drawers inside the large compartment, and a poison bottle receptacle pivotally mounted against the inner wall of the door with a lock mechanism to prevent access to the poison bottles except by a key.

SUMMARY OF THE INVENTION

It is an object of the invention to provide a combination medicine cabinet and jewelry box combination in a wall hung cabinet housing in which the compartments for jewelry are protected from contamination or other damage from items in the compartment for medicinal items.

It is an object of the invention to provide a combination medicine cabinet and jewelry box combination in a wall hung cabinet housing wherein inadvertent opening of the door to the compartment having medicinal items while the door to one or more of the jewelry compartments is open is deterred.

It is an object of the invention to provide a combination medicine cabinet and jewelry box combination in a wall hung cabinet housing wherein the door to one when opened acts as a deterrent to inadvertent opening of the door to another of the compartments in such combination.

DESCRIPTION OF PREFERRED EMBODIMENT

Figure 1:
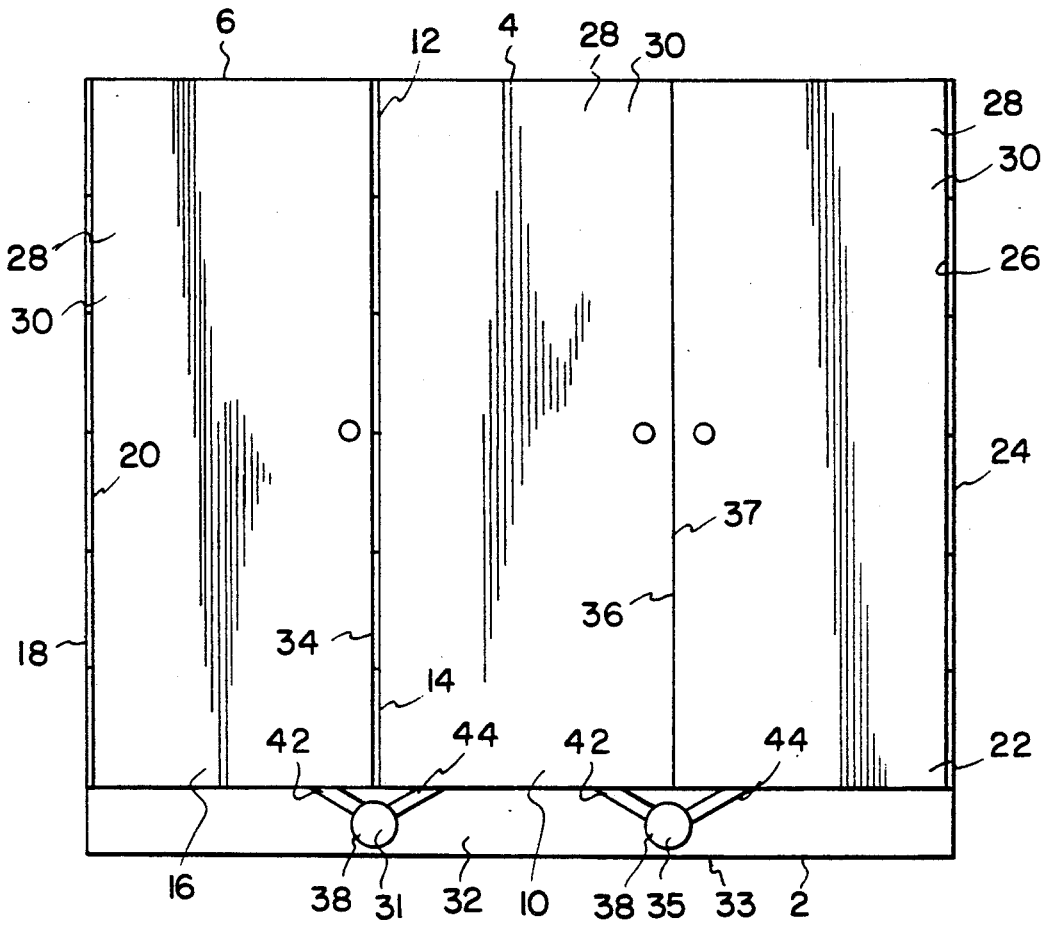
FIG. 1 is an elevation view of a wall hung cabinet housing in accordance with this invention having a compartment for medicinal items and two adjacent compartments for jewelry items on each side of the compartment for medicinal items.

A medicine cabinet and jewelry box combination in accordance with the present invention includes a cabinet housing 2 having a first compartment 4 for storing medicinal items, a second compartment 6 along one side of the medicine compartment 4 in which to store jewelry, and a third compartment 8 along the opposite side of the medicine compartment 4 in which to also store jewelry.

The medicine compartment 4 has a door 10 pivotally mounted on a vertically extending hinge 12 along one side edge 14, for pivotal movement between an open and a closed position to open and close the medicine compartment 4.

The jewelry compartment 6 has a door 16 pivotally mounted on a vertically extending hinge 18 along one side edge 20, for pivotal movement between an open and a closed position to open and close the jewelry compartment 6.

The jewelry compartment 8 has a door 22 pivotally mounted on a vertically extending hinge 24 along one side edge 26, for pivotal movement between an open and a closed position to open and close the jewelry compartment 8.

Each door 10, 16 and 22 has a mirror 28 on its outwardly facing wall 30.

A lock one-release another mechanism is provided for use with this invention which automatically locks one door in its closed position when moved to release the adjacent door so it can be opened. The lock one-release another mechanism is movable between a both adjacent doors locked position, a first door locked-second door released position, and a second door locked-first door released position.

A mechanism of this type includes a first rotatable lock one-release another member 31 rotatably mounted on the front wall 32 of the base 33 of the cabinet housing 2 at a location below the unhinged edge 34 of jewelry compartment door 16 and the hinged edge 14 of the medicine compartment door 10.

A second lock one-release another member 35 is also rotatably mounted on the front wall 32 of the base 33 of the cabinet housing 2. This second lock one-release another member 35 is located below the unhinged side edge 36 of the medicine compartment door 10 and the unhinged edge 37 of the jewelry compartment door 22. The first and second lock one-release another members 31 and 35 also include a rotatable hand grasp dial 38, a rotatable shaft 39 extending axially thereof through an aperture 40 extending through the front wall 32 of the housing base 33, a first lock arm 42 affixed to the shaft 39 extending radially therefrom and a second lock arm 44 affixed to the shaft 39 extending radially therefrom, in the same path of rotation as the first lock arm 42 and spaced apart radially therefrom somewhat more than ninety degrees.

Figure 3:
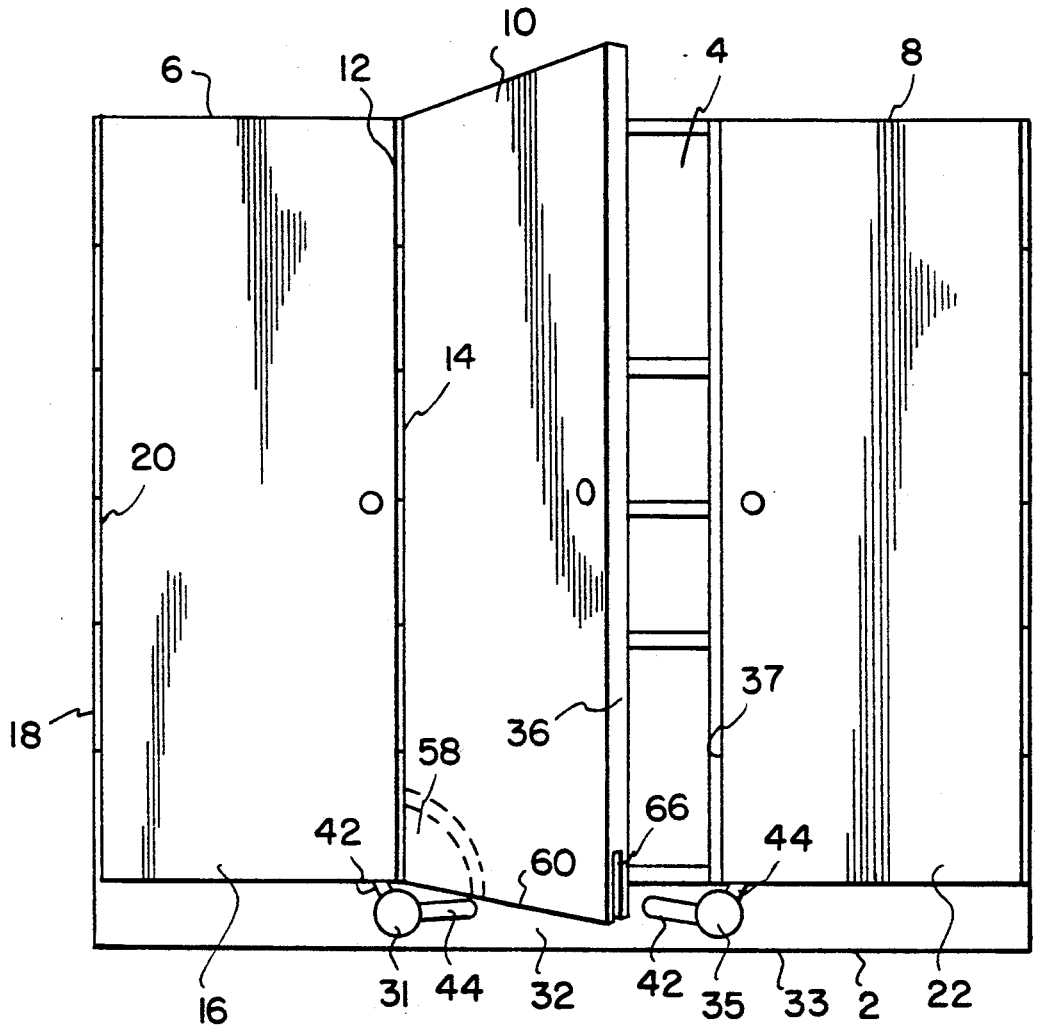
FIG. 3 is an elevation view of the cabinet housing shown in FIG. 1 with the doors to the compartments for jewelry items shown in their closed position, and the door to the compartment for medicinal items shown in its partially open position.
Figure 4:
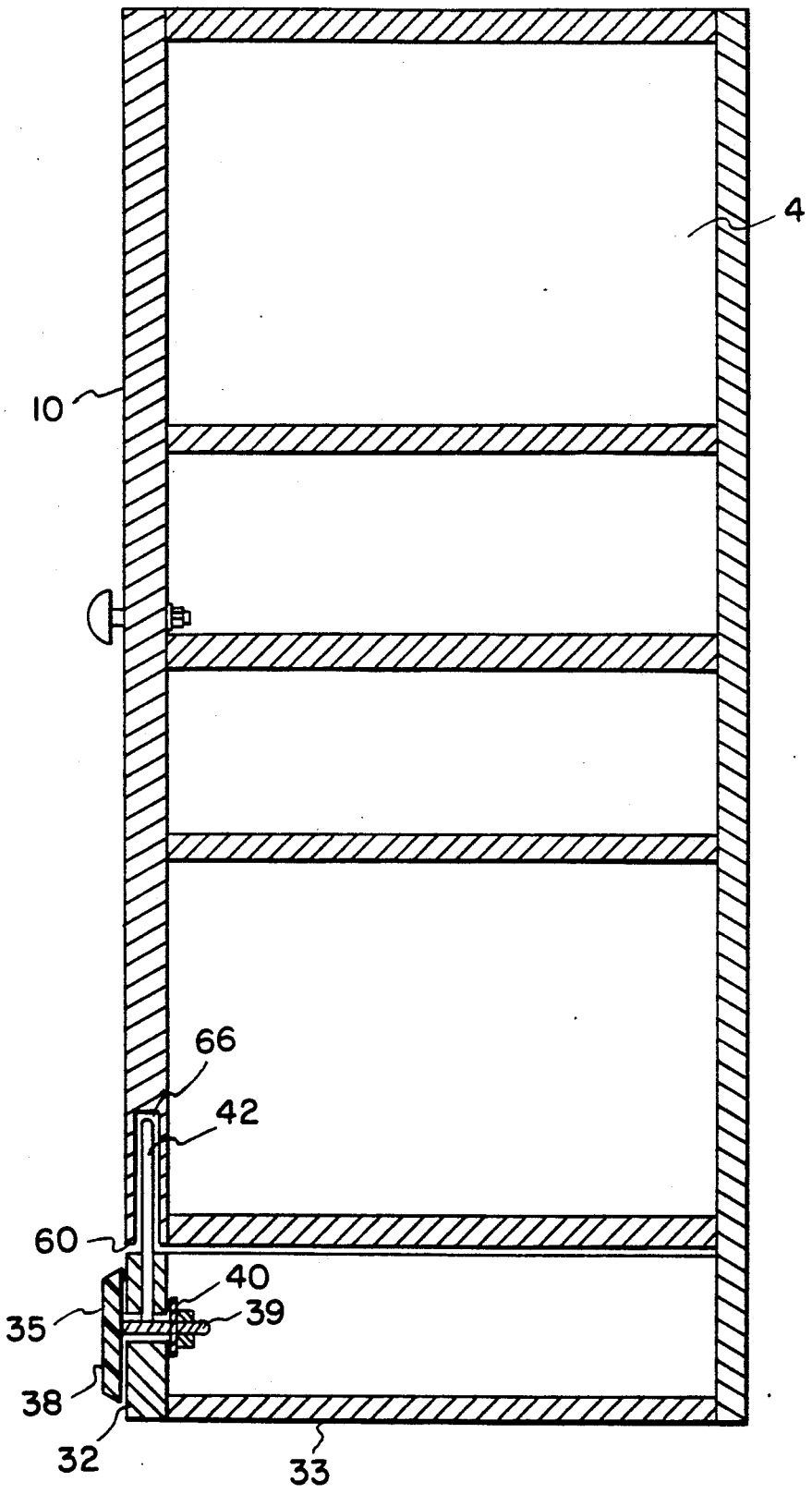
FIG. 4 is a section view taken on line 4—4 of FIG. 2.

When the jewelry compartment door 16 of jewelry compartment 6 and the medicine compartment door 10 are in their closed position, a receiving slot 54 in the lower portion of door 16 opening to the lower edge 56 thereof lies in the same path of rotation as the first lock arm 42 of the first lock one-release another member 31, and positioned to receive it in the slot 54 when the lock one-release another member 31 is rotated to its both adjacent doors locked position (as shown in FIG. 1) and to its first door locked-second door released position wherein the jewelry compartment door 16 is the first door and the adjacent medicine compartment door 10 is the second door (as shown in FIG. 3) wherein the medicine compartment door 10 is shown partially open.

When the medicine compartment door 10 is in its closed position, a receiving slot 58 in the lower portion of door 10 opening to the lower edge 60 thereof near its hinged side edge 14 lies in the same path of rotation as the second lock arm 44 of the first lock one-release another member 31, and positioned to receive it in the slot 58 when the lock one-release another member 31 is rotated to its both adjacent doors locked position and to its second door locked-first door released position wherein the jewelry compartment door 16 is the first door and the adjacent medicine compartment door 10 is the second door.

Figure 2:
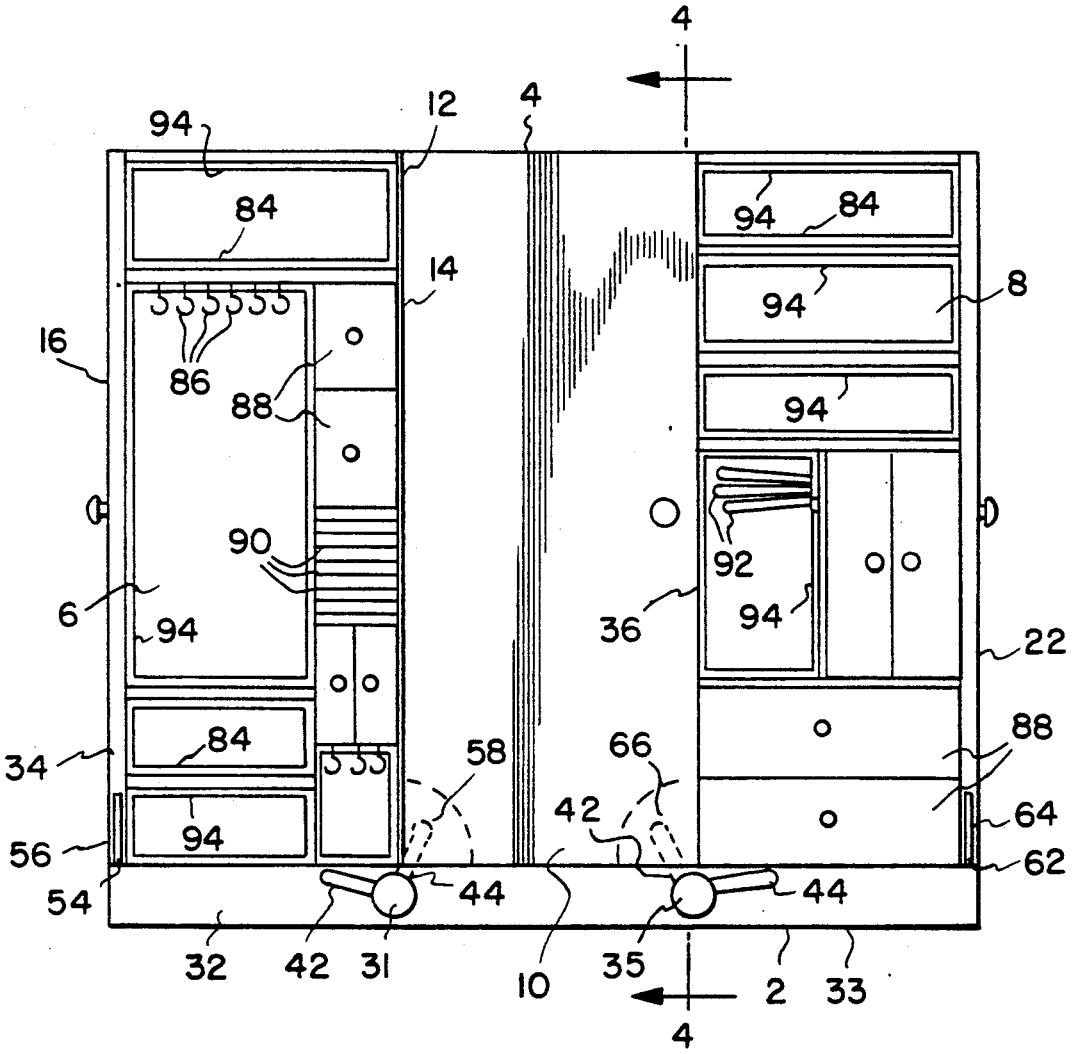
FIG. 2 is an elevation view of the cabinet housing shown in FIG. 1 with the doors to the compartments for jewelry items shown in their open position, and the door to the compartment for medicinal items closed.

Thus, when the jewelry compartment door 16 is to be opened, the lock one-release another member 31 is rotated to its second door locked-first door released position, at which time the first lock arm 42 is rotated far enough in the counter clockwise direction as seen in FIG. 2 to move out of the receiving slot 54 and clear the lower edge 56 of the door 16, whereby the jewelry compartment door 16 can be opened. At such time, the second lock arm 44 is rotated to extend even further into the receiving slot 58 of the medicine compartment door 10 to lock it in its closed position. This prevents inadvertent opening of the medicine compartment 4 when the jewelry compartment 6 is open to prevent vapors, caustic substances, toxic substances and odors emanating from items in the medicine compartment 4 from entering into the jewelry compartment 6 where they could otherwise contaminate and damage items kept in the jewelry compartment.

When the jewelry compartment door 22 of jewelry compartment 8 and the medicine compartment door 10 are in their closed positions, a receiving slot 62 in the lower portion of the door 22 opening to the lower edge 64 thereof lies in the same path of rotation as the second lock arm 44 of the second lock one-release another member 35, and positioned to receive it in the slot 62 when the lock one-release another member 35 is rotated to its both adjacent doors locked position (as shown in FIG. 1) and to its first door locked-second door released position wherein the jewelry compartment door 22 is the first door and the adjacent medicine compartment door 10 is the second door (as shown in FIG. 3) wherein the medicine compartment door 10 is shown partially open.

When the medicine compartment door 10 is in its closed position, a receiving slot 66 in the lower portion of door 10 opening to its lower edge 60 near its unhinged side edge 36 lies in the same path of rotation as the first lock arm 42 of the second lock one-release another member 35, and positioned to receive it in the slot 66 when the lock one-release another member 35 is rotated to its both adjacent doors locked position and to its second door locked-first door released position wherein the jewelry compartment door 22 is the first door and the adjacent medicine compartment door 10 is the second door.

Thus, when the jewelry compartment door 22 is to be opened, the lock one-release another member 35 is rotated to its second door locked-first door released position, at which time the second lock arm 44 is rotated far enough in the clockwise direction as seen in FIG. 2 to move out of the receiving slot 62 and clear the lower edge 64 of the door 22, whereby the jewelry compartment door 22 can be opened. At such time, the first lock arm 42 is rotated to extend even farther into the receiving slot 66 of the medicine compartment door 10 to lock it in its closed position. This prevents contamination and damage to items in the jewelry compartment 8 from vapors, caustic and toxic substances, and odors emanating from items in the medicine compartment 4, which could otherwise occur if the medicine compartment door 10 was inadvertently opened while the jewelry compartment door 22 was also open.

In order to open the medicine compartment door 10 with the jewelry compartment doors 16 and 22 closed, the first lock one-release another member 31 has to be rotated clockwise as seen in FIG. 3 until the second lock arm 44 moves out of the receiving slot 58 near the hinged side edge 14 of the medicine compartment door 10 and clear the lower edge 60 thereof at which time the first lock arm 42 extends even farther into the receiving slot 54 of the jewelry compartment door 16 to prevent it from being opened. The second lock one-release another member 35 has to be rotated counter clockwise as seen in FIG. 3 until the first lock arm 42 moves out of the receiving slot 66 near the unhinged side edge 36 of the medicine compartment door 10 to also clear the lower edge 60 thereof at which time the second lock arm 44 extends even farther into the receiving slot 62 of the jewelry compartment door 22 to prevent it from being opened.

Thus, neither one of the jewelry compartment doors 16 and 22 can be inadvertently opened while the medicine compartment door 10 has been opened. The items in the jewelry compartments 6 and 8 are thus protected from anything harmful that may emanate from the medicine compartment 4 when its door 10 has been opened.

Positioning of the doors themselves and the directions in which they may be opened can also provide protection of items in the jewelry compartments from harmful exposure to items in the medicine compartment of a medicine cabinet and jewelry box combination in accordance with this invention.

Figure 5:
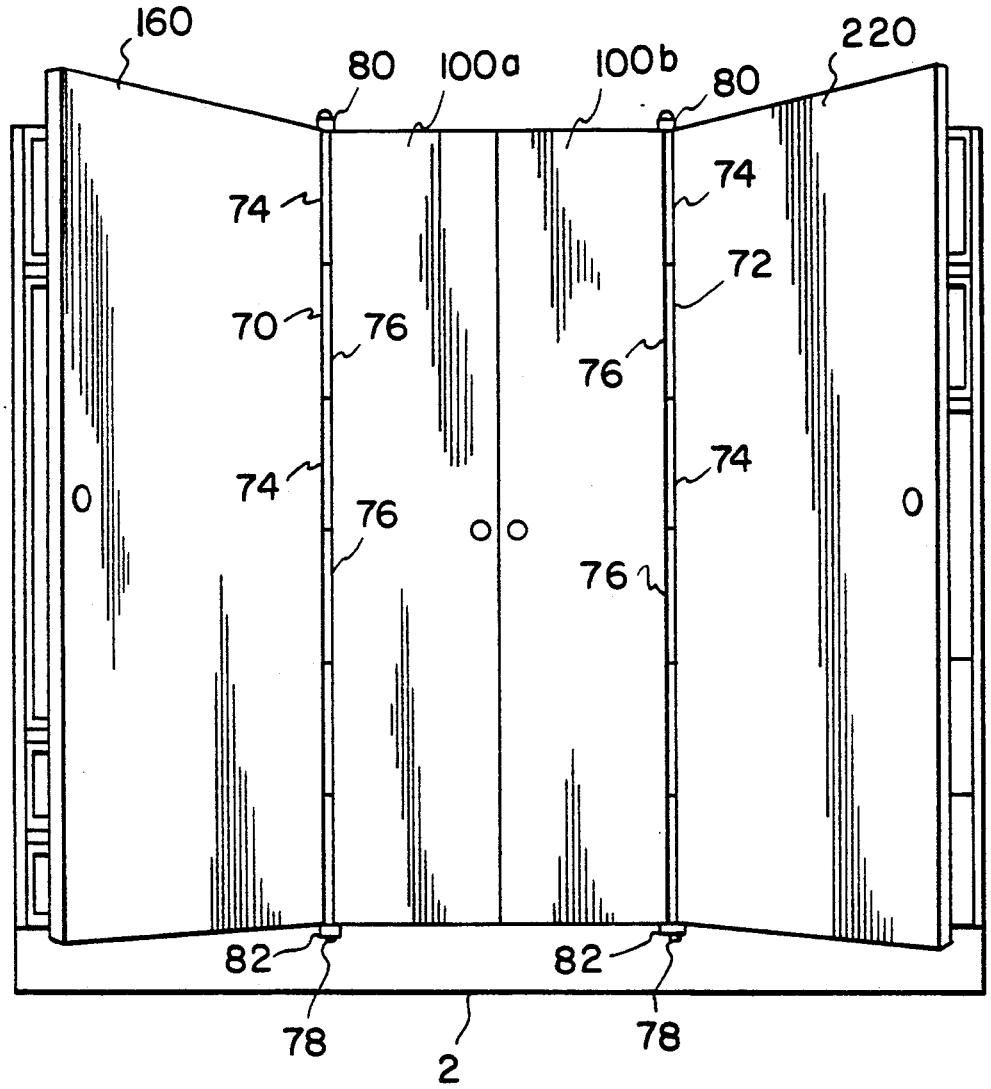
FIG. 5 is an elevation view of a modified embodiment of this invention.

The jewelry compartment doors 160 and 220 in the modification shown in FIG. 5 have their hinged side edges adjacent the hinged side edges of the medicine compartment doors 100*a* and 100*b* respectively. Thus the doors themselves serve as a barrier to communication from one compartment to the other even if the doors to the medicine compartment were opened inadvertently while the doors to the jewelry compartments were also open.

A common elongated hinge member 70 is provided for the adjacent jewelry compartment door 160 and medicine compartment door 100*a*. A common elongated hinge member 72 is provided for the adjacent jewelry compartment door 220 and medicine compartment door 100*b*.

Each elongated hinge member 70 and 72 comprise alternating hinge sleeves 74 and 76, and an elongated hinge pin 78 extending therethrough. The hinge sleeves 74 of hinge member 70 are secured to jewelry compartment door 160 and the hinge sleeves 76 thereof are secured to medicine compartment door 100*a*. The hinge sleeves 74 of hinge member 72 are secured to the jewelry compartment door 220 and the hinge sleeves 76 thereof are secured to medicine compartment door 100*b*.

Hinge brackets 80 are secured to the cabinet housing 2 at the top, and hinge brackets 82 are secured to the cabinet housing 2 at the bottom, each having apertures to receive the hinge pins 78 therethrough, thus securing the hinged doors to the cabinet housing 2.

The structure of providing adjacent doors with their hinged side edges adjacent each other is an effective deterrent against inadvertently opening both of such doors at the same time, and if inadvertently opened at the same time each door having such adjacent hinge structure acts as a barrier to communication of something emanating from one compartment entering into the other.

Figure 6:
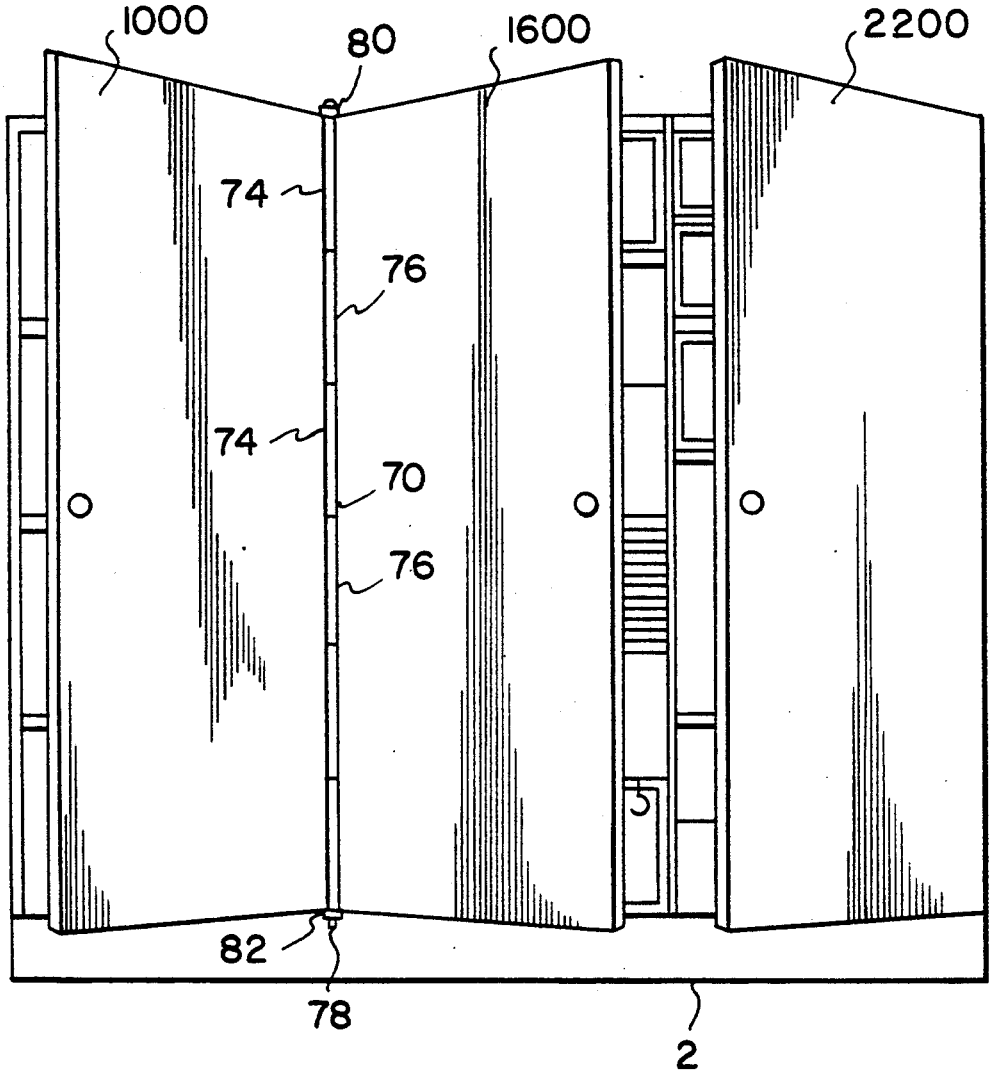
FIG. 6 is an elevation view of another modified embodiment of this invention.

The modification shown in FIG. 6 illustrates another modification of this invention in which the medicine compartment door 1000 is at the left hand side and the jewelry compartment doors 1600 and 2200 are adjacent each other at the right hand side of the cabinet housing 2.

The medicine compartment door 1000 and jewelry compartment door 1600 are both hinged together on the common hinge member 70, hinge sleeves 74 being secured to medicine compartment door 1000 and hinge sleeves 76 being secured to jewelry compartment door 1600.

This structure deters inadvertent opening of medicine compartment door 1000 if jewelry compartment door 1600 is open, and if it should be opened inadvertently the medicine compartment door 1000 swings outwardly in an arcuate path toward the jewelry compartments to serve as a barrier to deter substances emanating from the medicine compartment from reaching the jewelry compartments.

The jewelry compartments in accordance with this invention include shelves 84, hooks 86, drawers 88, felt covered friction retaining slots 90, and pivotally mounted rods 92 to receive and hold various items of jewelry. The individual sub-compartments to hold jewelry are preferably lined with a material which prevents or retards tarnishing, such as the layer 94 of flannel material impregnated with a substance that retards and prevents tarnishing available from a company by the name of Hold Everything in San Francisco, Calif., whose mailing address is Post Office Box 7807, San Francisco, Calif. 94120-7807. Lining the sub-compartments of the jewelry compartments of a cabinet with a layer of material which retards and prevents tarnishing of jewelry items is a convenient and improved structural way of exposing jewelry items to the beneficial results of such material to retard and prevent tarnishing.

I claim:

1. A medicine cabinet and jewelry box combination comprising a housing, a first compartment in said housing to store medicinal items, a second compartment in said housing to store jewelry, a first door to open and close said first compartment for medicine, a second door to open and close said second compartment for jewelry, and lock one-release another means operable between at least a first and second operating position to lock said first door in the closed position and release said second door for opening when moved to said first operating position and to lock said second door in the closed position and release said first door for opening when moved to said second operating position, wherein said first compartment to store medicine includes a first vertically extending side wall and a spaced apart second vertically extending side wall, said second compartment to store jewelry being positioned along said first vertically extending side wall of said first compartment to store medicine, said housing including a third compartment in which to store jewelry, said third compartment to store jewelry being positioned along said second vertically extending side wall of said first compartment to store medicine, a third door to open and close said third compartment, a second one of said lock one-release another means operable between at least a first and second operating position to lock said first door in the closed position and release said third door for opening when moved to said first operating position and to lock said third door in the closed position and release said first door for opening when moved to said second operating position.

2. A medicine cabinet and jewelry box combination as set forth in claim 1, wherein said second one of said lock one-release another means is operable between said first and second operating positions plus a third operating position to lock both said first and third doors in the closed position.

* * * * *